US006040123A

United States Patent [19]

Maudhuit et al.

[11] Patent Number: 6,040,123

[45] Date of Patent: Mar. 21, 2000

[54] FINAL RINSING SOLUTION FOR COLOR PHOTOGRAPHIC PRODUCT

[75] Inventors: Cecile A. Maudhuit, Chalon sur Saone; Jacques Bulou, Saint-Remy, both of France

[73] Assignee: Eastman Kodak Company, Rochester, N.Y.

[21] Appl. No.: 09/322,621

[22] Filed: May 28, 1999

[51] Int. Cl.[7] ..... G03C 7/30

[52] U.S. Cl. ..... 430/463; 430/372; 430/428; 430/429

[58] Field of Search ..... 430/463

[56] References Cited

U.S. PATENT DOCUMENTS 5,645,980 7/1997 McGuckin et al. ..... 430/463
5,716,765 2/1998 McGuckin et al. ..... 430/463
5,952,158 9/1999 McGuckin et al. ..... 430/372

FOREIGN PATENT DOCUMENTS 0 638 834 A1 2/1995 European Pat. Off. .
0 674 221 A1 9/1995 European Pat. Off. .

*Primary Examiner*—Hoa Van Le
*Attorney, Agent, or Firm*—J. Lanny Tucker

[57] ABSTRACT

A final rinsing solution designed for the photographic processing of silver halide photographic products that comprises an anionic surfactant and a non-ionic surfactant the solution had a static surface tension less than or equal to 32 mN/m and a dynamic surface tension less than 50 mN/m. The solution is used in a method for processing silver halide photographic products such as color reversal products.

13 Claims, No Drawings

FINAL RINSING SOLUTION FOR COLOR PHOTOGRAPHIC PRODUCT

FIELD OF THE INVENTION

The present invention relates to a rinsing solution designed for the processing of silver halide photographic materials, and a method for processing silver halide photographic materials that uses said rinsing solution.

BACKGROUND OF THE INVENTION

Conventionally, the processing of color photographic materials comprises a color developing step, a bleaching step, a fixing step, a final rinsing step, and a drying step. By causing the rinsing solution to run evenly over the photographic product during the drying stage, the subsequent drying of the photographic product is improved. When the rinsing solution does not run evenly, marks appear on the photographic product due to uneven evaporation of the rinsing solution during drying.

It is therefore especially important to have a rinsing solution that runs evenly over the photographic product, especially over the support of the photographic product.

So that the rinsing solution runs more evenly, rinsing solutions containing surfactants are conventionally used.

For example, U.S. Pat. No. 5,534,396 describes a rinsing solution containing a non-ionic surfactant and an anionic surfactant, this rinsing solution having a surface tension less than or equal to 32 mN/m. Such a rinsing solution runs more evenly over the perforations in the photographic material, leaving fewer marks on the photographic material after processing and drying. However, this rinsing solution leaves drying defects in the form of smears of calcium and(or) sodium salts on the surface of the film support. These defects are due to an uneven flow of the solution layer over the film support surface.

It is desirable to have a rinsing solution that runs more evenly over the surface of the processed photographic product, not just where its perforations are, but over all the surface of the support of the product.

SUMMARY OF THE INVENTION

The present invention concerns an aqueous final rinsing solution for silver halide photographic products that comprises an anionic surfactant and a non-ionic surfactant, said solution having a static surface tension less than or equal to 32 mN/m and a dynamic surface tension less than 50 mN/m.

The invention further concerns a processing method for a silver halide color photographic material that comprises treating the photographic product with the rinsing solution of this invention.

DETAILED DESCRIPTION OF THE INVENTION

In the scope of this invention, the static surface tension is measured by the conventional method known as the Whilhelmy blade method. The dynamic surface tension is measured by the Whilhelmy blade method with an overflow vessel; the blade must be perfectly wettable. With the overflow vessel method, the liquid surface is constantly renewed, and the instantaneous age of the surface is estimated at less than one second. This method was described in a paper by J. F. Padday, 2nd International Congress of Surface Activity, I, 1, 1957, and more recently in the Journal of Colloid and Interface Science 165, 221–228, 1994, II, Surfactant Solutions.

The useful non-ionic surfactant in the scope of the invention can be any photographically inert surfactant, i.e., one that does not modify the sensitometric features of the processed photographic product. It must also eventually form a homogeneous stable solution. The non-ionic surfactant can be a copolymer of dimethylsiloxane and oxyalkyl, such as Silwet® L-7607 sold by Union Carbide, a perfluoro polyethylene glycol such as Zonyl® sold by Dupont Co., a polypropylene-polyethylene glycol such as Pluronic® sold by BASF, or a p-nonylphenoxy polyglycol such as OLIN 10G® sold by Olin Corporation.

The non-ionic surfactants that are particularly useful for this invention are the polyethoxyl surfactants. The preferred polyethoxyl surfactants have the formula $R^1$—$(B)_x$—$(E)_m$—D wherein $R^1$ is an alkyl group having from 8 to 20 atoms of carbon, B is a phenyl group, x is 0 or 1, E is —$(OCH_2CH_2)$—, m is an integer between 6 and 20 and D is —OH or —$CH_3$.

Such surfactants are for example octylphenoxy polyoxyethylene(9)ethanol known as Triton X-100® sold by Union Carbide, octylphenoxy polyoxyethylene(12)ethanol known as Triton X-102® sold by Union Carbide, octylphenoxy polyoxyethylene(30–40)ethanol known as Triton X-405® sold by Union Carbide, alkyl($C_{12}$–$C_{15}$) polyoxyethylene(7)-ol known as Neodol 25-7® sold by Shell Chemical, and tridecyl polyoxyethylene(12)-ol known as Renex 30® sold by ICI. The preferred surfactants are Triton X-102® or Triton X-100®.

In one embodiment, the non-ionic surfactant is present in the solution in an amount in the range from 0.05 to 1.0 g/l, preferably from 0.1 to 0.5 g/l. In a specific embodiment, the amount of non-ionic surfactant in the solution of this invention is about 0.2 g/l.

The anionic surfactant can be any surfactant that is photographically inert and stable under the conditions of the photographic process. The preferred anionic surfactants are surfactants with sulfate or sulfonate group(s). In a preferred embodiment, the useful anionic surfactants are dialkyl sulfosuccinates of formula:

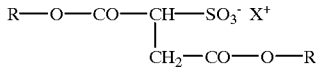

wherein R is an alkyl or ethoxyalkyl group, the alkyl group comprising more than 4 atoms of carbon, preferably 5 to 20 atoms of carbon, and X is a cation, for example $Na^+$.

For example, the dialkyl sulfosuccinates useful in the scope of this invention are sodium dihexyl sulfosuccinate or sodium dioctyl sulfosuccinate.

In a specific embodiment, the anionic surfactant is sodium dioctyl sulfosuccinate known as EMPIMIN OT75® and EMPIMIN OP70® sold by Albright & Wilson.

In a preferred embodiment, the anionic surfactant is present in the solution in an amount in the range from 0.05 to 1.0 g/l, preferably from 0.1 to 0.5 g/l. In a specific embodiment, the amount of anionic surfactant in the solution of this invention is about 0.2 g/l.

The amounts of surfactant are given as an indication only, because the static and dynamic surface tension of the rinsing solution depends on the nature of the surfactant used, and also on the amount of these surfactants in the rinsing solution. Those skilled in the art can determine by trial the optimal amounts of surfactant to be used according to the selected surfactant.

In a specific embodiment, the rinsing solution of the invention is such that the static surface tension is less than 30 mN/m and the dynamic surface tension is less than or equal to 40 mN/m. In a preferred embodiment, the rinsing solution is such that the static surface tension is less than 28 mN/m and the dynamic surface tension is less than or equal to 40 mN/m.

In a specific embodiment, the difference between the dynamic surface tension and the static surface tension of the rinsing solution is less than 20 mN/m, preferably less than 10 mN/m.

To favor an even flow of the solution, the receeding de-wetting angle of the rinsing solution of the present invention should preferably be low. In an especially preferred embodiment, the rinsing solution of the present invention has a receeding de-wetting angle less than or equal to 5 degrees. The receeding de-wetting angle is measured by the Whilhelmy blade method when the test blade is withdrawn from the solution.

The rinsing solution of this invention can be obtained from a concentrated solution that is diluted in water. The concentrations of surfactants in the concentrate will be determined according to the dilution factor required and the static and dynamic surface tensions required for the ready-to-use rinsing solution.

In addition to the compounds described above, the rinsing solution can contain other compounds, for example biocides, chelating agents, or preservatives provided that the rinsing solution is free of dye stabilizing agent. The pH of this rinsing solution is generally in the range from 6 to 8.

In any case, the rinsing solution is free.

The rinsing solution of this invention is used in a method for processing color photographic products that comprises a color developing bath, a bleaching bath and a fixing bath (or a single bleaching-fixing bath), the rinsing solution being used after the bleaching and fixing step. The process can include intermediate baths such as washing baths and stop baths. All these baths are described in detail in *Research Disclosure*; September 1996, N°38957, Sections XIX and XX.

The color photographic products that can be treated using the method of this invention are conventional color photographic products that comprise a support coated with one or more layers of silver halide emulsion and one or more auxiliary layers. These photographic products are described in detail in *Research Disclosure*; Sections I to XVII.

In a specific embodiment, the processing method in which the rinsing solution is used is a process for reversal photographic products. This process comprises a black-and-white development step, a chemical reversal step, a color development step, a pre-bleach step, a bleaching step, a fixing step, and a final rinsing step using the solution of this invention.

The invention is described in detail in the following examples.

EXAMPLES

The following examples employ a Refrema tank developing machine and a Kodak E6® process comprising a black-and-white developing step, a reversal step, a color development step, a pre-bleach step, a bleaching step, a fixing step, and a final rinsing step followed by a drying step. The process also comprises one or more washing steps between these different steps to eliminate chemicals from the different process baths.

For each of the experiments described below, 4 strips of Kodak Ektachrome E100 S or E100 SW (35 mm×1.70 m) reversal film were used.

Example 1

In this example, the strips of film described above were processed using the Kodak E6® process in which the final rinsing solution is an aqueous solution that comprises (active part of surfactants):

Non-ionic surfactant: Neodol 25-7® 0.2 g/l

Anionic surfactant: Zonyl FSO® 0.025 g/l

After processing of the films, the drying marks visible in reflected light were quantified for each strip.

The level of marking was scored as follows:

0: no visible mark

1: one narrow or partly narrow smear

2: two narrow smears along whole length of film

3: two wide smears along whole length of film

4: two wide smears and diffuse marks on the film surface

The surface tensions of the rinsing solution and results are given in Table 1 below.

Example 2

(Invention)

In this example, the film strips described above were processed with the Kodak E6® process in which the rinsing solution was an aqueous solution comprising (active part of surfactants):

Nonionic surfactant: Triton X-100® 0.2 g/l

Anionic surfactant: Empimin OT 75® 0.2 g/l

The level of marking was determined for each strip. The surface tensions of the rinsing solution and results are given in Table 1 below.

Example 3

(Invention)

In this example, the film strips described above were processed with the Kodak E6® process in which the rinsing solution was an aqueous solution comprising (active part of surfactants):

Nonionic surfactant: Triton X-100® 0.2 g/l

Anionic surfactant: Empimin OP 70® 0.2 g/l

The level of marking was determined for each strip. The surface tensions of the rinsing solution and results are given in Table 1 below.

Example 4

(Comparative)

In this example, the film strips described above were processed with the Kodak E6® process in which the rinsing solution was an aqueous solution comprising (active part of surfactants):

Nonionic surfactant: Renex 30® 0.11 g/l

Nonionic surfactant: Silwet L-7607® 0.25 g/l

The level of marking was determined for each strip. The surface tensions of the rinsing solution and results are given in Table 1 below.

TABLE 1

| | Total number of marks on 4 strips | Static surface tension (mN/m) | Dynamic surface tension (mN/m) |
|---|---|---|---|
| example 1 | 7 | 24 | 57 |
| example 2 Inv* | 4 | 27 | 31 |
| example 3 Inv* | 5 | 27 | 41 |
| example 4 Comp* | 8 | 27 | 49 |

*The rinsing solutions described have a receeding de-wetting angle of zero deg.

These examples show that the rinsing solution of the present invention is able to reduce drying marks by causing the layer of solution to run more evenly over the support of the photographic product.

We claim:

1. An aqueous rinsing solution for silver halide photographic products comprising an anionic surfactant and a non-ionic surfactant wherein said solution has a static surface tension less than or equal to 32 mN/m and a dynamic surface tension of less than 50 mN/m.

2. The aqueous rinsing solution of claim 1 wherein the static surface tension is less than 30 mN/m and the dynamic surface tension is less than or equal to 40 mN/m.

3. The aqueous rinsing solution of claim 1 wherein the static surface tension is less than 28 mN/m and the dynamic surface tension is less than or equal to 40 mN/m.

4. The aqueous rinsing solution of claim 1 wherein said non-ionic surfactant is a polyethoxyl surfactant.

5. The aqueous rinsing solution of claim 1 wherein said anionic surfactant is a dialkyl sulfosuccinate salt.

6. The aqueous rinsing solution of claim 1 that is free of dye stabilizing agent.

7. The aqueous rinsing solution of claim 4 wherein said non-ionic surfactant is octylphenoxy polyoxyethylene (9) ethanol.

8. The aqueous rinsing solution of claim 5 wherein said anionic surfactant is sodium dioctyl sulfosuccinate.

9. The aqueous rinsing solution of claim 1 wherein each of said surfactants is present in an amount from 0.05 to 1.0 g/l.

10. The aqueous rinsing solution of claim 9 wherein each of said surfactants id present in an amount from 0.1 to 0.5 g/l.

11. The aqueous rinsing solution of claim 1 wherein the difference between the dynamic surface tension and the static surface tension is less than 20 mN/m.

12. An method for processing an exposed silver halide color photographic product comprising treating said photographic product with the aqueous rinsing solution of claim 1.

13. The method of claim 12 wherein said color photographic product is a reversal silver halide photographic product.

* * * * *